United States Patent [19]

Rychlewski

[11] Patent Number: 4,478,590

[45] Date of Patent: Oct. 23, 1984

[54] DEPRESSION CATHODE STRUCTURE FOR CATHODE RAY TUBES HAVING SURFACE SMOOTHNESS AND METHOD FOR PRODUCING SAME

[75] Inventor: Thaddeus V. Rychlewski, Seneca Falls, N.Y.

[73] Assignee: North American Philips Consumer Electronics Corp., New York, N.Y.

[21] Appl. No.: 335,301

[22] Filed: Dec. 28, 1981

[51] Int. Cl.[3] ..... H01J 9/04

[52] U.S. Cl. ..... 445/50; 313/346 R; 264/61

[58] Field of Search ..... 445/50, 51; 427/77; 264/61; 313/346 R, 346 DC

[56] References Cited

U.S. PATENT DOCUMENTS

| | | | |
|---|---|---|---|
| 3,110,081 | 11/1963 | Hendriks | 445/51 |
| 3,160,780 | 12/1964 | Coppola | 313/346 R |
| 3,184,636 | 5/1965 | Dore et al. | 313/346 R X |
| 3,238,596 | 3/1966 | Rich et al. | 445/51 |
| 3,257,703 | 6/1966 | Coad et al. | 427/77 X |
| 3,615,901 | 10/1971 | Medicus | 445/50 X |

*Primary Examiner*—Kenneth J. Ramsey

*Attorney, Agent, or Firm*—Thomas A. Briody; Jack Oisher; John C. Fox

[57] ABSTRACT

Depression cathode structures for cathode ray tubes are produced by dispensing liquid cathode material into the depression of a metallic supporting substrate, removing excess cathode material by passing a doctor blade across the substrate surface and over the depression, and drying the cathode layer to a substantially immobile state. The cathode layer may optionally be further shaped prior to substantially complete drying thereof.

6 Claims, 7 Drawing Figures

DEPRESSION CATHODE STRUCTURE FOR CATHODE RAY TUBES HAVING SURFACE SMOOTHNESS AND METHOD FOR PRODUCING SAME

CROSS-REFERENCE TO RELATED APPLICATIONS

Concurrently filed application Ser. No. 335,302, now U.S. Pat. No. 4,459,322, claims a cathode structure produced from a critically formulated slurry of cathode material.

BACKGROUND OF THE INVENTION

1. Field of the Invention

This invention relates to cathode structures for cathode ray tubes, and to a method for producing them, and more particularly relates to depression cathode structures produced from liquid cathode material and evidencing surface smoothness.

2. Prior Art

Cathode structures for cathode ray tubes desirably exhibit uniform electron emissions over an extended life cycle and under a variety of operating conditions. In addition, such cathode structures must be manufactured at the lowest possible cost. Because of such stringent requirements, particularly reliability and cost, there is great reluctance on the part of high volume manufacturers of cathode ray tubes to introduce new cathode structures or methods. Nevertheless, presently used cathode structures and methods exhibit limitations sufficiently troublesome to justify continuing investigations of alternate structures and methods.

These limitations include poor adherence of the emissive layer to its substrate, non-uniformity of emissions, and variations in the cathode-to-grid spacings ($K-G_1$ spacings) of the electron gun, resulting in out-of-specification values for cut-off voltages. Both non-uniformity of emissions and variations in the $K-G_1$ spacings can result from non-uniformity in the emissive layer. Particularly in the case of the sprayed coatings widely in use today, such non-uniformity can occur within a single cathode coating not only as thickness variation but also as surface roughness. Such variations in thickness and lack of surface smoothness can lead to variations in quality of the spot produced from the impingement of the electron beam on the phosphor screen. Such variations can also lead to high voltage arcing between the cathode and adjacent gun parts, which can contribute to shorter life of the cathode.

Adherence problems arise, particularly during operation near the high end of the normal temperature range, and can appear as lifting, flaking, or blistering of the emissive coating. Such adherence problems may be due in part to incomplete contact between relatively porous sprayed coatings and the underlying substrate. Such poor adherence can contribute to lower emission and shorter life of the cathode.

In addition to the above limitations, the spray coating process requires close control of a number of operating parameters, including air pressure of the spray gun, distance of the gun from the cathode, and the relative humidity of the atmosphere in the spray chamber, in order to achieve coatings of good quality. It is also necessary to spray each cathode up to 100 times in order to obtain the desired coating thickness. Such multiple spraying of cathodes of small area relative to the cross sectional area of the spray beam, results in the consumption of large quantities of the spray coating formulation.

"Depression" cathode structures are known in which cathode material is deposited within a cavity or depression in a cathode supporting structure. See, for example, U.S. Pat. Nos. 3,652,894; 3,148,056; 2,321,149; 2,929,133; and 2,716,716. However, such structures have not enjoyed wide acceptance in the manufacture of cathode ray tubes, possibly because of inherent difficulties in adapting such structures to mass production techniques. In addition, these prior art structures have not provided a cathode with controlled surface characteristics.

Accordingly, objectives of the present invention include: providing a cathode structure for cathode ray tubes which exhibits good adherence between the cathode layer and its supporting substrate; providing a cathode layer which exhibits both uniformity of thickness and surface smoothness; providing a cathode layer which exhibits a shaped surface; and providing a method for producing such structures simply and reliably.

SUMMARY OF THE INVENTION

In accordance with the invention, there is provided a cathode structure for cathode ray tubes which is a depression structure wherein the cathode emissive layer is substantially confined within a depression in the surface of a supporting substrate of metallic material and exhibits both good adherence to the substrate and a high degree of thickness uniformity, and wherein the upper surface of the cathode layer is substantially coplanar with the substrate surface and exhibits a high degree of smoothness and a controlled shape, preferably a substantially flat shape.

Further, in accordance with the invention, there is provided a method for producing a depression cathode structure for cathode ray tubes, the method comprising: providing a supporting substrate of a metallic material having a depression in the surface thereof; dispensing a predetermined quantity of a liquid cathode material comprising potentially electron emissive material into the depression; and drying the liquid cathode material to form a cathode layer in the depression.

Preferably, the quantity of cathode material dispensed is in excess of that required to fill the depression, and the excess material is subsequently removed. Such excess material is preferably removed by passing a shaping tool such as a doctor blade, along the substrate surface and over the depression, to shape the upper surface of the cathode layer and render it substantially co-planar with the substrate surface. Following removal of excess cathode material, the surface may be further shaped, such as by pressing a shaping tool into the surface.

The depression in the substrate is preferably concave or comprised of a substantially flat base portion and an annular sidewall portion.

In accordance with still another preferred embodiment, following evaporation of the solvent mixture and drying of the cathode layer, the structure is: first heated to a temperature sufficient to substantially convert the alkaline earth carbonates to alkaline earth oxides; and then heated in a vacuum at a higher temperature, such higher temperature sufficient to activate the cathode structure by reducing at least a portion of the alkaline earth oxides to base metal, and to sinter at least a portion of the particles to each other and to the substrate.

DESCRIPTION OF THE PREFERRED EMBODIMENT

Figures 1A, 1B, 1C, 1D:
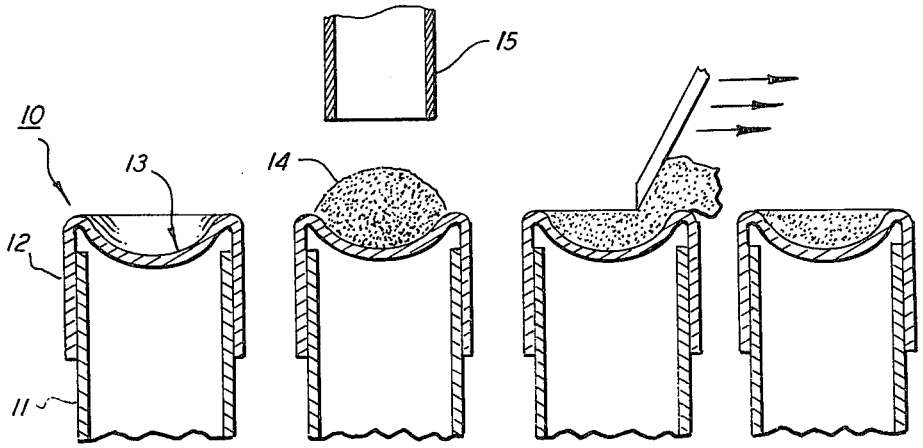
FIGS. 1(*a*) through 1(*d*) are section views showing stages in the formation of one embodiment of a depression cathode structure of the invention, in which the upper surface of the cathode layer is flat.

Referring now to FIGS. 1(*a*) through 1(*d*), there are shown stages in the formation of one embodiment of a depression cathode structure of the invention. FIG. 1(*a*) shows a supporting substrate 10, comprised of sleeve 11 and top cap 12, containing a concave depression 13 in the upper surface thereof. Substrate 10 is typically composed of an alloy of nickel typically containing about two to four weight percent tungsten, up to about 0.1 weight percent zirconium, remainder substantially nickel. Typical commercial alloys used for this purpose are known by the tradenames "Nitung 4", having a composition of about 96 weight percent nickel, 4 weight percent tungsten, and "Nizir-W", having a composition of about 98 weight percent nickel, about 2 weight percent tungsten, and about 0.05 weight percent zirconium.

The liquid cathode material 14 containing potentially electron emissive material is deposited in depression 13 in excess of the quantity needed to fill it, as shown in FIG. 1(*b*).

The liquid cathode material could be either a slurry, that is, a suspension of solid particles in a liquid supporting vehicle, or a solution of such particles in a liquid solvent. As used herein, the term "liquid" means a material which spontaneously assumes the shape of its container without the application of external force.

The solid particles from which the electron emissive material is formed consists essentially of a mixture, usually coprecipitated, of particles of alkaline earth carbonates selected from the group consisting of barium, strontium and calcium carbonates.

Preferably, barium carbonate is present in the amount of about 55 to 60 weight percent, strontium carbonate is present in the amount of about 36 to 45 weight percent, and calcium carbonate is present in the amount of about 0 to 4 weight percent of solids.

As shown in FIG. 1(*b*), the liquid is dispensed in the form of a drop from a hypodermic needle 15 or other microdispenser. Because the depression provides support for the drop, a high degree of latitude is afforded in the control of viscosity and wettability of the drop, through control of the solids content and the physical characteristics of the slurry vehicle or solvent. Furthermore, following dispensing of the drop, increasing the solids content of the slurry or concentration of the solution is readily achieved prior to doctor blading or other forming by partial drying to reduce the amount of liquid present, if so desired. Excess cathode material 14 is then removed by doctor blade 16, as shown in FIG. 1(*c*). The remaining cathode material is then substantially completely dried, resulting in the depression cathode structure shown in FIG. 1(*d*), wherein the cathode surface is substantially flat and co-planar with the surrounding substrate surface.

While it is preferred to add excess cathode material to the depression, and then remove the excess with a shaping tool, it will be appreciated by those skilled in the art that the benefits of surface smoothness and flatness may also be achieved by dispensing a predetermined quantity of liquid cathode material into the depression just sufficient to fill the depression upon substantially complete drying of the material. While requiring closer control of process parameters, such method nevertheless obviates the need for subsequent removal of excess material.

As will be appreciated by those skilled in the art, the described method is highly susceptible to automation techniques. For example, cathode substrates containing suitable depressions therein as described above can be continuously indexed under a liquid-cathode dispensing location, at which location drops of liquid cathode material are dispensed sequentially into the depressions of the indexing substrates; then the substrates can be optionally passed through one or more controlled drying stations; then indexed under a doctor blading location at which excess cathode material is removed; and finally passed through further and final controlled drying stations.

Figures 2A, 2B:
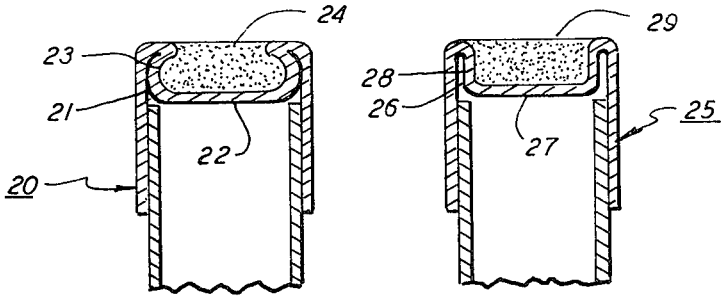
FIGS. 2(*a*) and 2(*b*) are section views of other embodiments of the cathode structure of the invention in which the upper surface of the cathode layer is flat, having other depression cross-sections.

FIGS. 2(*a*) and 2(*b*) shows other embodiments of the depression cathode structure of the invention. FIG. 2(*a*) shows structure 20 having a depression 21 of a flat base portion 22 and annular inwardly curving side walls 23, and filled with cathode layer 24. FIG. 2(*b*) shows a similar structure 25 having a depression 26 of a flat base portion 27 and annular straight side walls 28, and filled with cathode layer 29.

Figure 3:
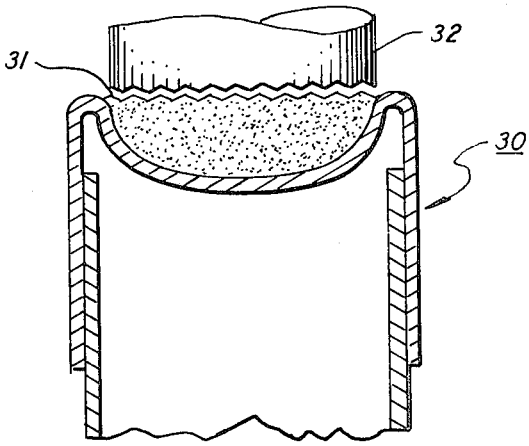
FIG. 3 is a section view of still another embodiment of the invention, in which the upper surface of the cathode layer is grooved.

Another feature of the invention is the step of further changing or shaping the surface of the cathode material prior to substantially complete drying thereof. As liquid is removed from the cathode material, it passes from a liquid state to a plastic state. As used herein, the term "plastic" means the ability to assume a particular shape upon the application of an external force. Such shape is substantially retained subsequent to the cathode material being reduced to a substantially completely dry and immobile state. FIG. 3 shows one embodiment of a depression cathode structure 30 of the invention wherein a grooved or sawtooth contour 31 is formed in the upper surface of the cathode material while in a plastic state by application of forming tool 32 prior to substantially complete drying. As will be appreciated, other regular and random patterned or roughened surfaces may be effected by virtue of other pressing or shaping tools acting upon the cathode material confined within the depression of the substrate. Such surfaces may, for example, include projections or depressions useful in locating or centering the cathode structures within electron gun structures during assembly operations.

The shaped and dried cathode layer now adhered to the substrate contains "potentially emissive" material, so referred to because only subsequent processing renders the material electron emissive. Such processing normally takes place during and immediately after evacuation of the cathode ray tube and sealing of the electron gun in the evacuated tube. Such processing is referred to as "breakdown" and "activation", wherein during tube evacuation the alkaline earth carbonates are broken down or thermally decomposed to the respective oxides, and subsequently the oxides are activated to base metal, in which form barium in particular is electron emissive. During heating to achieve breakdown, which normally occurs at a temperature of about 900° C., any residual organic material from the slurry or solvent is also removed from the cathode structure. During activation which normally occurs at a temperature of about 1050° C., some sintering together of the remaining inorganic particles in the substrate occurs, as well as some sintering of the particles to the substrate. Thus, a highly adherent cathode structure is formed. In addition, to their adherence to the substrate, such structures are also characterized by a high degree of thickness uniformity and surface smoothness, greater than can be achieved with any of the sprayed coatings now in use. Such thickness uniformity and surface smoothness are preserved in the activated cathode structure, enabling close control of cathode-to-grid spacing, (and thus cut-off voltage), as well as uniform electron emissions, resulting in uniform spot quality at the screen.

INDUSTRIAL APPLICABILITY

Depression cathode structures described herein are particularly suitable for use in cathode ray tubes for color and black-and-white entertainment and data display applications.

I claim:

1. Method for producing a depression cathode structure for a cathode ray tube, comprising:

(a) providing a supporting substrate of an alloy of nickel comprising about 2 to 4 weight percent tungsten, up to about 0.1 weight percent zirconium, remainder substantially nickel, having a depression in the surface thereof, the depression entirely surrounded by the substrate, (b) dispensing drop-wise a predetermined quantity of a liquid cathode material containing potentially electron emissive material into the depression, the potentially electron emissive material consisting essentially of particles of alkaline earth carbonates selected from the group consisting of barium carbonate, strontium carbonate and calcium carbonate, and (c) drying the liquid cathode material to form a cathode layer in the depression.

2. The method of claim 1 wherein the quantity of cathode material dispensed is in excess of that required to fill the depression and the excess material is subsequently removed.

3. The method of claim 2 wherein the excess material is removed by passing a shaping tool along the substrate surface and over the depression, to render the upper surface of the cathode layer substantially coplanar with the substrate surface.

4. The method of claim 3 wherein the shaping tool is a doctor blade, to render the surface substantially flat.

5. The method of claim 4 wherein following removal of excess cathode material, the upper surface of the cathode layer is further shaped.

6. The method of claim 5 wherein the layer is shaped by pressing a shaping tool into the surface.

* * * * *